US011154889B2

(12) United States Patent
Rech

(10) Patent No.: US 11,154,889 B2
(45) Date of Patent: Oct. 26, 2021

(54) SPRAYER FOR LIQUIDS WITH PRECOMPRESSION CHAMBER

(71) Applicant: Silgan Dispensing Systems Vicenza, S.R.L., Grandview, MO (US)

(72) Inventor: Gilberto Rech, Roassano Veneto (IT)

(73) Assignee: Silgan Dispensing Systems Vicenza, S.R.L., Grandview, MO (US)

( * ) Notice: Subject to any disclaimer, the term of this patent is extended or adjusted under 35 U.S.C. 154(b) by 234 days.

(21) Appl. No.: 16/435,472

(22) Filed: Jun. 8, 2019

(65) Prior Publication Data

US 2019/0291123 A1 Sep. 26, 2019

Related U.S. Application Data

(63) Continuation of application No. 14/360,669, filed as application No. PCT/EP2012/073517 on Nov. 23, 2012, now Pat. No. 10,315,208.

(30) Foreign Application Priority Data

Nov. 28, 2011 (IT) ..... MI2011A002168

(51) Int. Cl.
*B05B 11/00* (2006.01)

(52) U.S. Cl.
CPC ..... *B05B 11/3009* (2013.01); *B05B 11/0064* (2013.01); *B05B 11/0075* (2013.01); *B05B 11/3011* (2013.01); *B05B 11/3064* (2013.01)

(58) Field of Classification Search
CPC ... B05B 11/0062–0075; B05B 11/3009; B05B 11/3011; B05B 11/3016–3019; B05B 11/304; B05B 11/3064; B05B 11/3066–3071
See application file for complete search history.

(56) References Cited

U.S. PATENT DOCUMENTS 4,819,835 A * 4/1989 Tasaki ..... B05B 11/3011 222/383.1
5,622,317 A 4/1997 Foster et al.
(Continued)

FOREIGN PATENT DOCUMENTS

| | | |
|---|---|---|
| EP | 0616127 B1 | 3/1994 |
| WO | 9618572 A1 | 6/1996 |
| WO | 2004065021 A1 | 8/2004 |

OTHER PUBLICATIONS

International Search Report from PCT/EP2012/073517 dated Jan. 18, 2013.

*Primary Examiner* — Cody J Lieuwen
(74) *Attorney, Agent, or Firm* — Barlow, Josephs & Holmes, Ltd.; Stephen J. Holmes

(57) ABSTRACT

A sprayer of liquids with trigger-operated pump includes a body which can be attached to the mouth of a container and a nozzle for delivery of the liquid. In the body is formed a pumping chamber in communication with the interior of the container and with the delivery nozzle. A one-way valve of suction and of delivery is located in the outlet duct of the liquid a system of precompression comprising a piston pushed with constant force by a spring in occlusion of the outlet duct such as to increase the pressure of the liquid in the outlet duct during the pumping, and also thereby increase the speed or the acceleration of the liquid in output from the nozzle.

20 Claims, 6 Drawing Sheets

(56) References Cited

U.S. PATENT DOCUMENTS

| | | | | |
|---|---|---|---|---|
| 5,628,434 | A * | 5/1997 | Foster | B05B 11/0064 222/383.1 |
| 6,131,820 | A | 10/2000 | Dodd | |
| 2002/0008164 | A1* | 1/2002 | Yanagida | B05B 12/002 239/525 |
| 2006/0054642 | A1* | 3/2006 | Buti | B05B 11/3074 222/383.1 |
| 2008/0149671 | A1 | 6/2008 | Sweeton et al. | |
| 2008/0191061 | A1* | 8/2008 | Inaba | B05B 11/3011 239/533.1 |
| 2014/0319244 | A1 | 10/2014 | Rech | |

* cited by examiner

SPRAYER FOR LIQUIDS WITH PRECOMPRESSION CHAMBER

CROSS-REFERENCE TO RELATED APPLICATIONS

This application is a continuation of U.S. application Ser. No. 14/360,669, filed May 27, 2014, which is a Sectional 371 National Stage filing of PCT/EP2012/073517, filed Nov. 23, 2012.

BACKGROUND OF THE INVENTION

The object of the present invention is a sprayer for liquids, in particular a pump sprayer actuated manually by means of a trigger lever, provided with a system of precompression suitable for expelling the liquid with a greater speed or acceleration.

A sprayer generally comprises a main body provided with a base with a threaded ring nut or with bayonet coupling to be attached to the mouth of a container of liquid, a delivery nozzle wherefrom the liquid is sprayed, a trigger lever which can be actuated by hand by the user and a pump which can be actuated by the trigger lever to aspirate the liquid from the container by means of a clipper tube and spray it via the delivery nozzle.

The pump provides a piston acting in a chamber formed in the body of the sprayer. The body of the sprayer comprises moreover an inlet duct which places in communication the interior of the container of the fluid with the chamber of the pump and an outlet duct which places in communication the chamber of the pump with the nozzle of the sprayer. A valve for fluid suction and delivery is provided inside or immediately upstream of the chamber of the pump, suitable for allowing in a selective and one-way manner the suction of the fluid from the container to the chamber of the pump and the delivery of fluid from the chamber of the pump towards the delivery nozzle.

In order to accelerate the exiting of the liquid from the sprayer, or to guarantee a regular jet of the liquid, normally nebulized, aside from the speed of actuation of the trigger lever, systems of precompression have been proposed, which co-operate with the piston actuated by the lever in order to increase the pressure of delivery of the liquid.

These known systems of precompression normally require numerous additional components in order to obtain the desired effect, with consequent increase in the cost of production. They are also somewhat complex and not easy to produce.

One example is represented by the lever sprayer device described in WO 96/18572 which, when the pump is actuated, releases the air from a chamber of the sprayer inside a container whereto the sprayer is connected. This device comprises a piston assembly defined by a pump-piston sliding inside a pump-chamber and by a release piston integrated in the pump-piston and slidingly positioned inside a release chamber, a pressure regulator sliding inside a channel and suitable for allowing the passage under pressure of the liquid directed towards the sprayer nozzle, with said pressure regulator comprising a valve sliding on a pin provided with peripheral grooves and formed in said channel for the passage of the liquid and a contrast spring positioned around said pin.

When the pump-piston is actuated manually by acting on the manual lever, it takes the liquid to be sprayed from the receptacle and pushes it against the valve thus causing a force of pressure on the same which slides in relation to the pin and, overcoming the action of contrast of the spring, allows the passage of the fluid via the grooves of the pin in the direction of the spray nozzle. The liquid impacts against the side wall of the valve and causes the raising thereof, acting against a membrane projecting perimetrically from the same.

This known solution, however, has some important disadvantages linked to the fact that it is presented as a complex and costly device as regards manufacture and, moreover, requires the prior evacuation of the air contained in the pumping chamber not sufficient for allowing the raising of the valve and, only when said chamber is filled with the liquid aspirated from the container, the raising of the valve takes place and therefore the system of precompression starts to function.

The object of the invention is that of providing a sprayer for liquids with system of precompression which is simple and economical to manufacture and highly reliable.

Another object of the invention is that of providing such a system of precompression which can easily be adapted, with few actions, to existing sprayers.

In particular the system of precompression that forms the object of the invention constitutes an improvement of the sprayer for liquids that is the object of the European patent EP 1585602, which is incorporated herein by reference in its entirety.

BRIEF SUMMARY OF THE INVENTION

The sprayer for liquids with a system of precompression has the features of the independent claims.

Advantageous embodiments of the invention are further recited in the dependent claims.

Substantially, in the outlet duct of the chamber of the pump, a second piston is provided, normally held in occlusion of this duct by a precompression spring, the elastic force whereof is overcome by the pressure of the fluid following actuation of the pump, with consequent displacement of the second piston and exiting of the fluid.

In this phase the precompression spring acting on the second piston exerts an additional pressure on the fluid, which is delivered at a greater speed.

Advantageously the aforesaid second piston and the precompression spring are placed in a widening of a vertical section of said duct of outlet from the chamber of the pump, which then continues with a horizontal section as far as the nozzle.

The second piston blocks, in non-operational condition, the passage of the fluid from said vertical section to said horizontal section of the outlet duct.

BRIEF DESCRIPTION OF THE DRAWINGS

Further features of the invention will be made clearer by the following detailed description, referred to one of its exemplary embodiments purely by way of a non-limiting example illustrated in the accompanying drawings, in which.

DETAILED DESCRIPTION OF THE INVENTION

Figure 1:
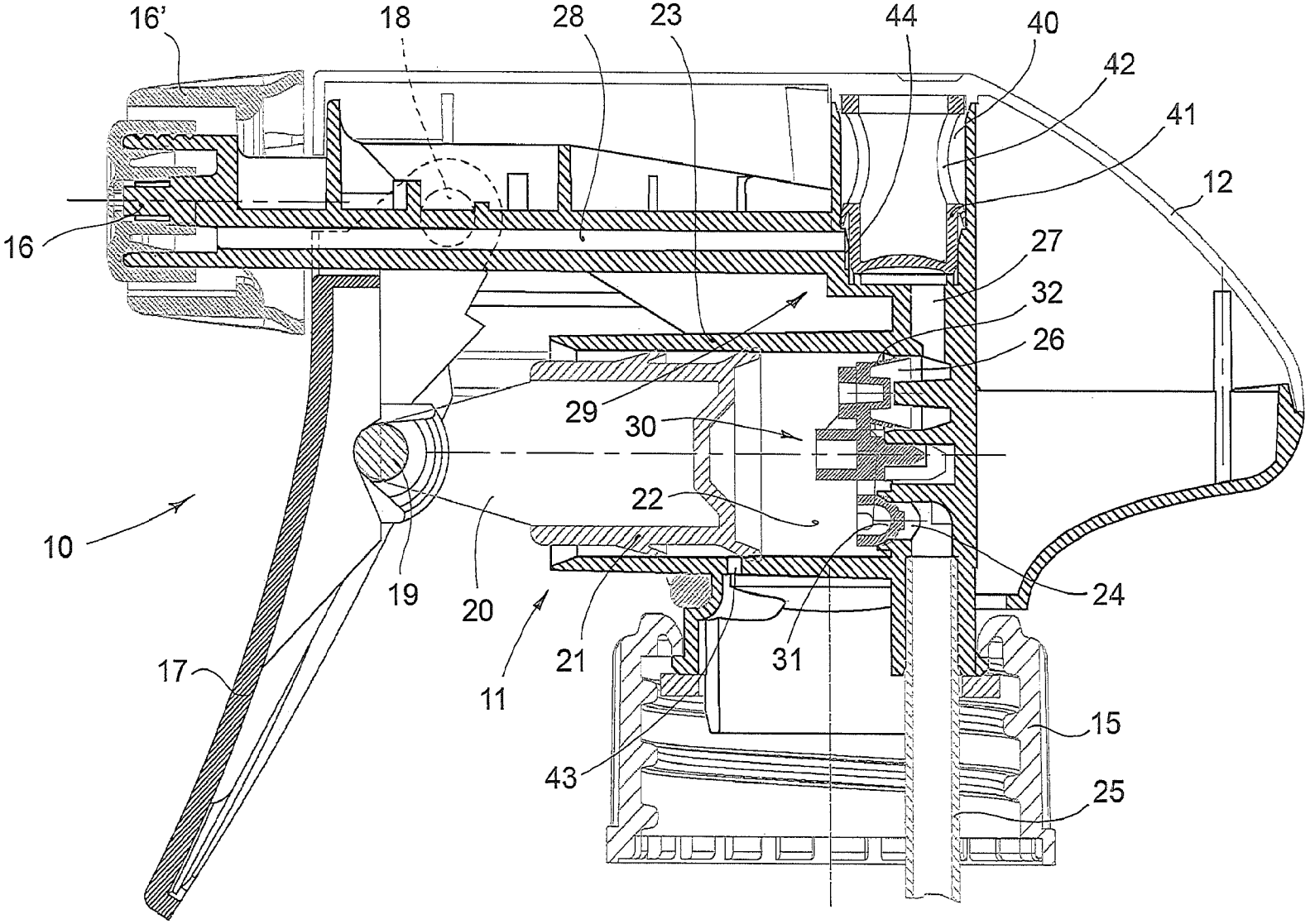
FIG. 1 is a median sectioned view of a sprayer with system of precompression according to the invention.

In the accompanying drawings a structure of sprayer is shown as described in the aforementioned European patent EP 1585602, whereto reference can be made for further details on the functioning of the sprayer, which will only be described in brief here.

The sprayer according to the invention, denoted as a whole by reference numeral 10, comprises a body 11 closed by a closure cap 12.

At the base of the body 11 of the sprayer an attachment ring nut 15 is rotatably mounted which has internal threading suitable for engaging with the external threading of the mouth of a container (not shown), suitable for containing a liquid, such as for example liquids for cleaning the home. Naturally the attachment of the sprayer on the container may also take place in a different way, for example by means of a bayonet coupling.

The body 11 of the sprayer has a substantially L shape and ends in a delivery nozzle 16 with an opening from which the liquid is delivered.

The delivery nozzle 16 is made up of a hole formed in a spray ring nut 16' which can be rotated in a manner in itself known between a position of blocking and a position of activation of the spraying.

For the actuation of the sprayer a trigger lever 17 is provided, hinged at one of its ends 18 to the body 11 and in one of its intermediate positions 19 to the stem 20 of a first piston or plunger 21, sliding in a chamber 22 of a pump body 23. In the rear wall of the chamber 22 a hole of inlet of the liquid 24 is formed, in communication with the interior of the container via a dipper tube 25, and an outlet hole 26 in communication with the spray nozzle 16, via a substantially L-shaped outlet duct 29, comprising a vertical section 27 and a horizontal section 28.

The aforesaid inlet and outlet holes for the liquid 24 and 26 are occluded respectively by a dome piece 31 and by a truncated cone body 32 of a one-way suction and delivery valve 30.

In the internal side wall of the chamber 22, on the side turned in the direction of the container wherefrom the dipper tube 25 takes the liquid, a hole or opening 43 is formed, suitable for allowing the reintegration of the air inside the container whereto the sprayer is connected, at each actuation of the pump.

The functioning of the one-way valve 30, described in greater detail in the aforementioned patent EP 1585602, is fairly intuitive.

By pressing the trigger lever 17, the liquid in the chamber 22 of the pump exerts a pressure against the valve 30, deforming the truncated cone shank 32 and then exiting through the outlet hole 26 to go towards the nozzle 16.

Figure 2:
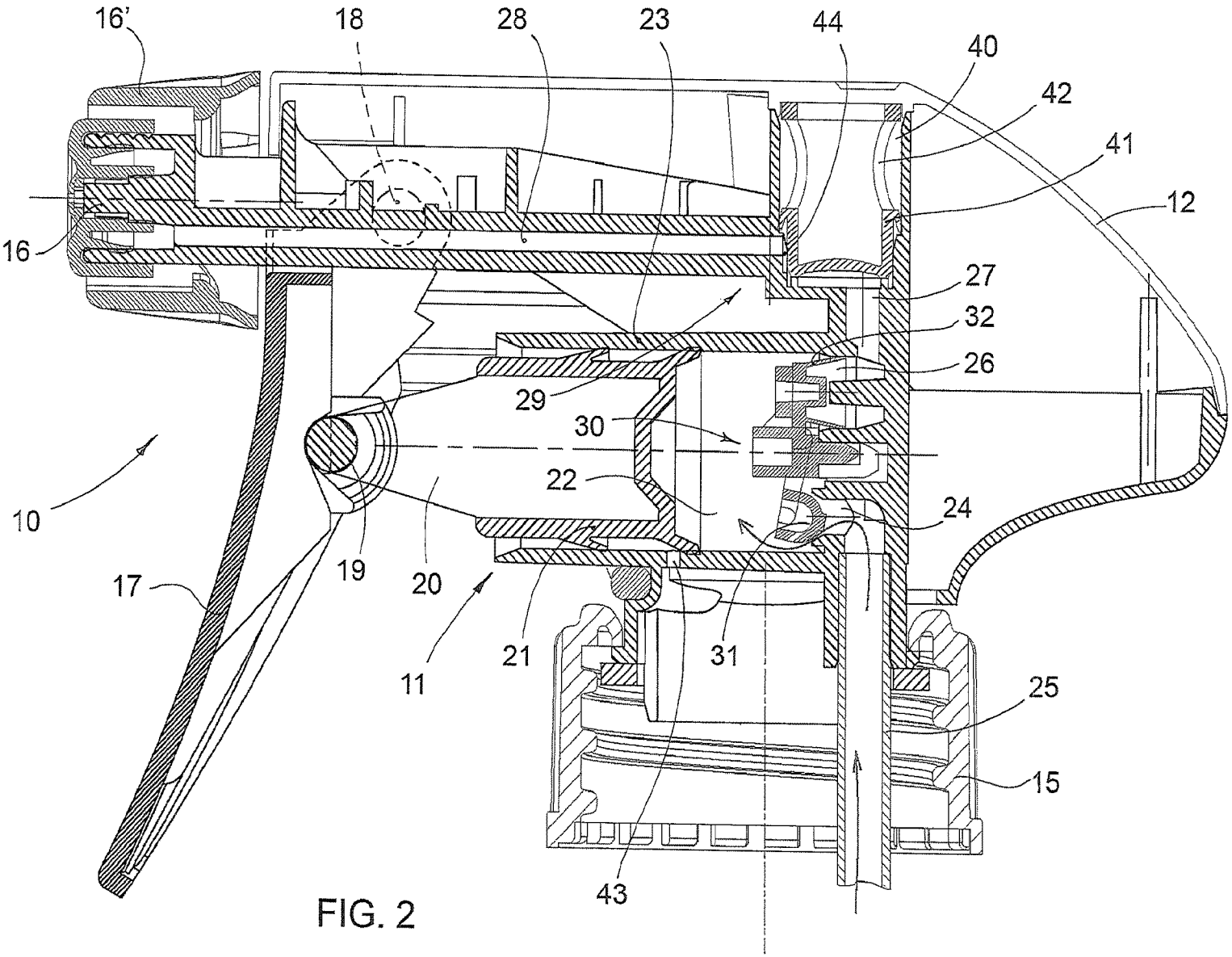
FIGS. 2 and 3 are similar views to that of FIG. 1, with the sprayer respectively in phase of suction and of delivery of the liquid.

When the trigger lever 17 is released and returns into the rest position through the action of elastic means not described, the plunger 21 creates a vacuum in the chamber 22 freeing the inlet hole 24, as shown in FIG. 2, making the liquid aspirated from the container flow into the chamber 22.

What has been described hitherto is considered prior art from the aforementioned patent EP 1585602.

According to the invention, the sprayer that is the object of the aforementioned European patent, as described hitherto, is equipped with a system of precompression of the liquid placed in the abovementioned outlet duct 29.

Figure 3:
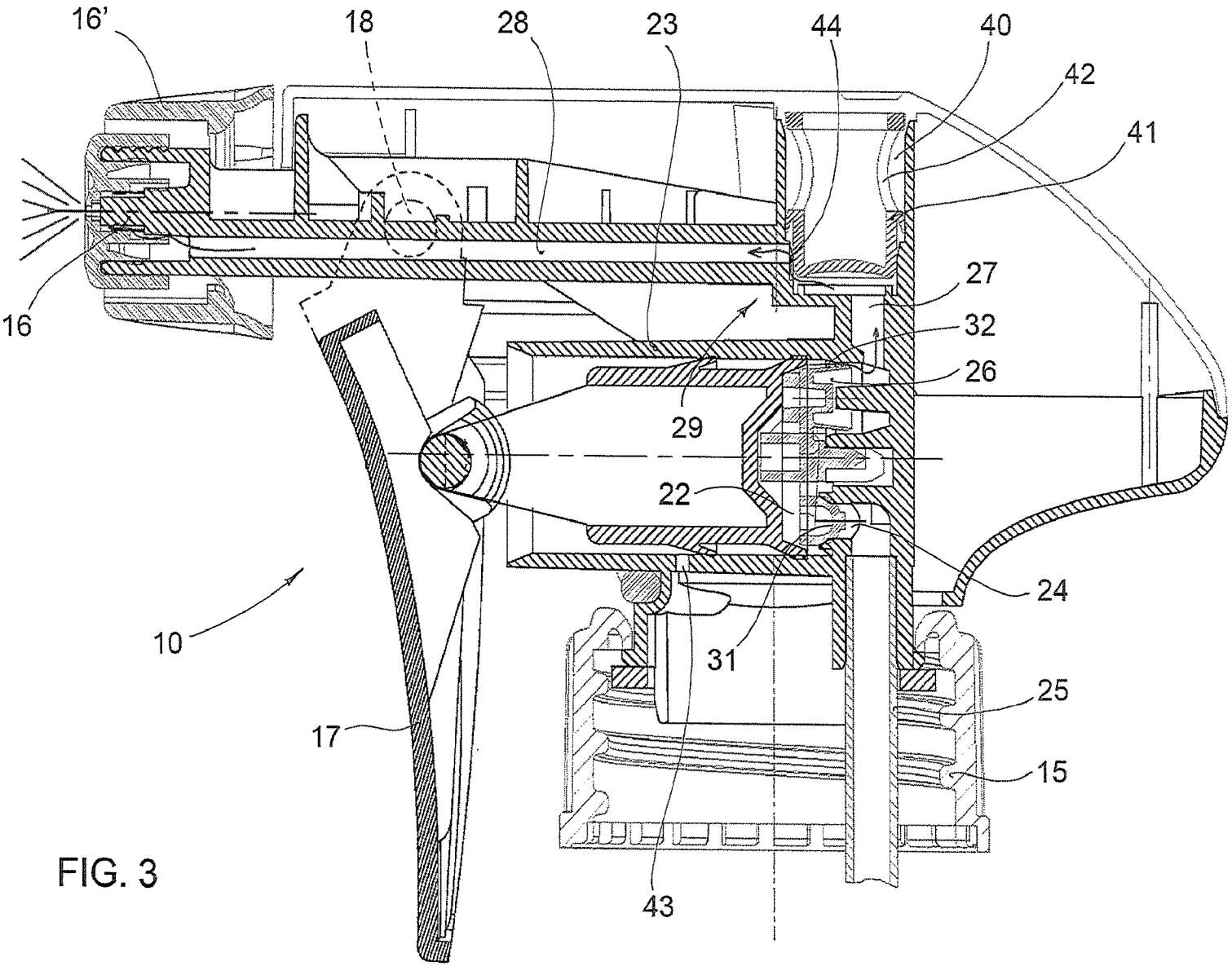

More particularly a widening and an extension upwards of the vertical section 27 of this duct are provided, such as to determine an advantageously cylindrical seat 40 open above, where it is closed by said closure cap 12 (FIGS. 1-3). Positioned sealingly sliding inside the seat 40, with a limited stroke, is a piston or plunger 41, which will also be referred to as second piston in order to distinguish it from the piston 21 of the pump.

Figure 6:
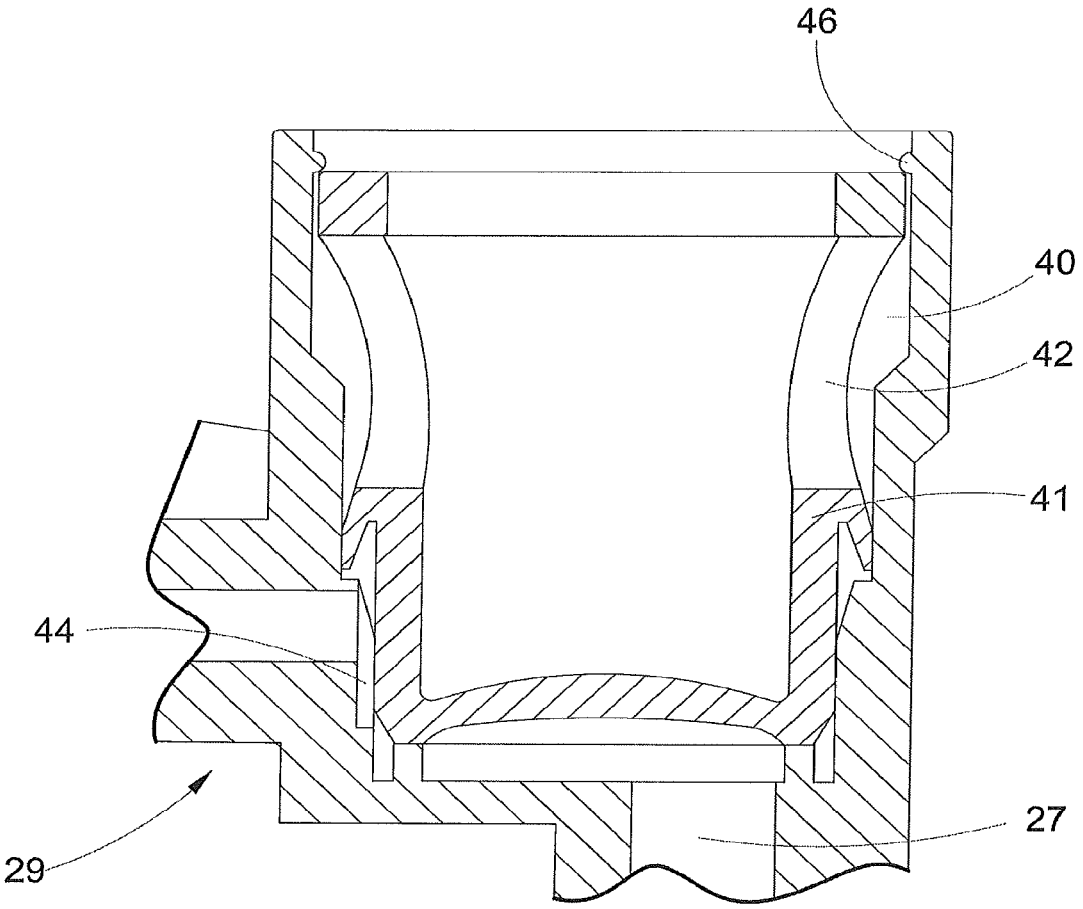
FIG. 6 shows an enlarged detail of the precompression spring mounted according to the embodiment as per FIG. 5.

Said advantageously cylindrical seat has a vertical passage 44, positioned externally to the piston 41 and such as to place in communication the horizontal section 28 and the vertical section 27, with said channel closed by means of the piston 41 (see the detail of FIG. 6).

Against the piston 41 acts an elastic element, in particular a spring 42, which abuts against the aforementioned closure cap 12, in order to push constantly downwards the piston 41, in occlusion of the vertical section 27 of the outlet duct 29.

The piston 41 and the spring 42 can be made as separate parts but advantageously are formed in a single part through injection molding of elastomeric or plastic materials, configuring the part 42 in such a way that it has the necessary elastic properties.

When the pressure of the fluid which acts on the base of the piston 41 via the vertical section 27 of the outlet duct 29 overcomes the elastic force of the spring 42, the piston 41 rises slightly, allowing the passage of the fluid in the horizontal section 28 via the vertical passage 44 as far as the delivery nozzle 16 which will be in the open position, as schematized in FIG. 3.

Figure 4:
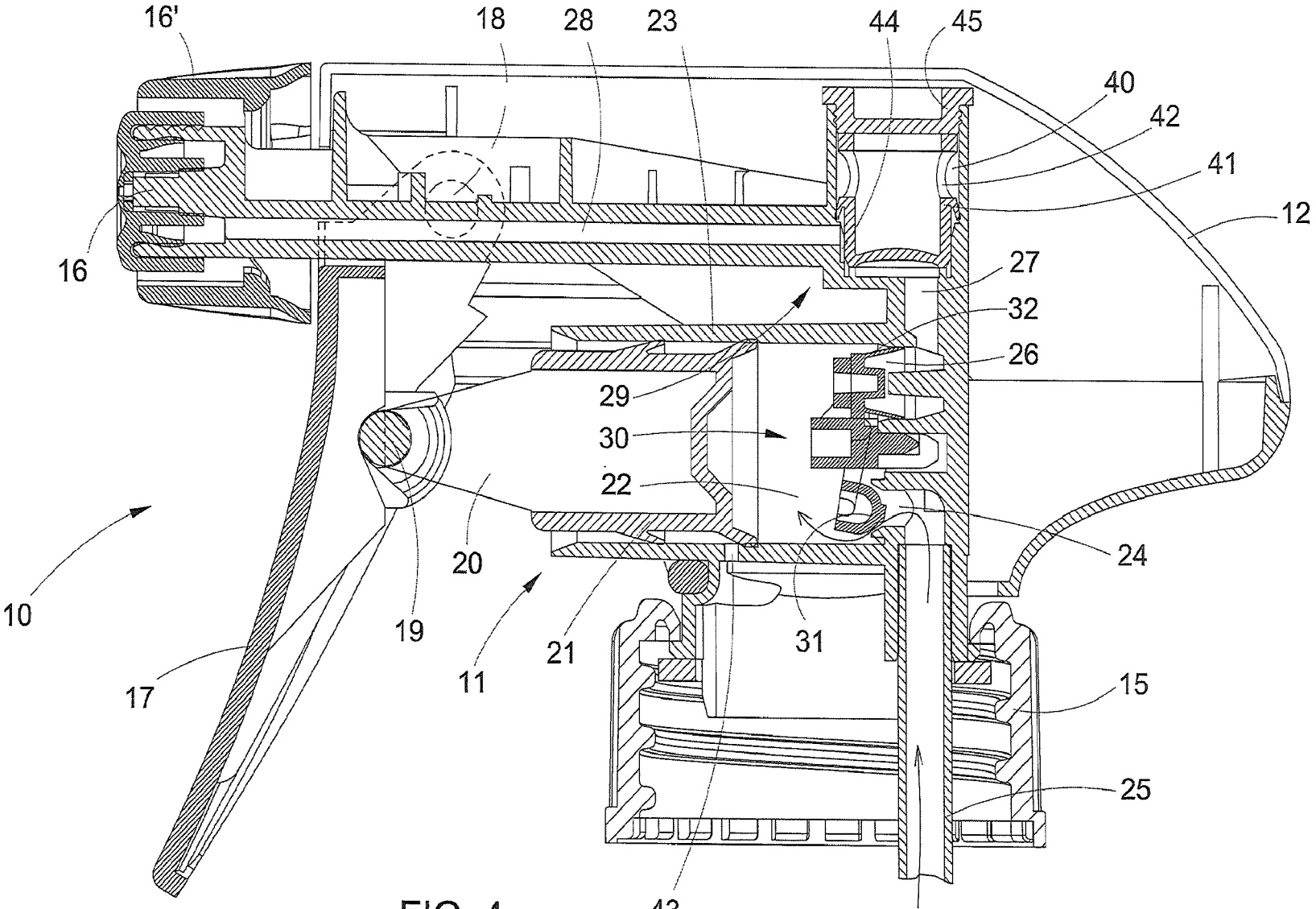
FIGS. 4 and 5 are views like those of FIG. 2 of two alternative embodiments.

According to an alternative embodiment, illustrated in FIG. 4, the seat 40 for housing of the piston or plunger 41 is closed above by means of a plug 45 stabilized in said seat by means of a threaded connection or of an undercut or in another known and suitable way.

Figure 5:
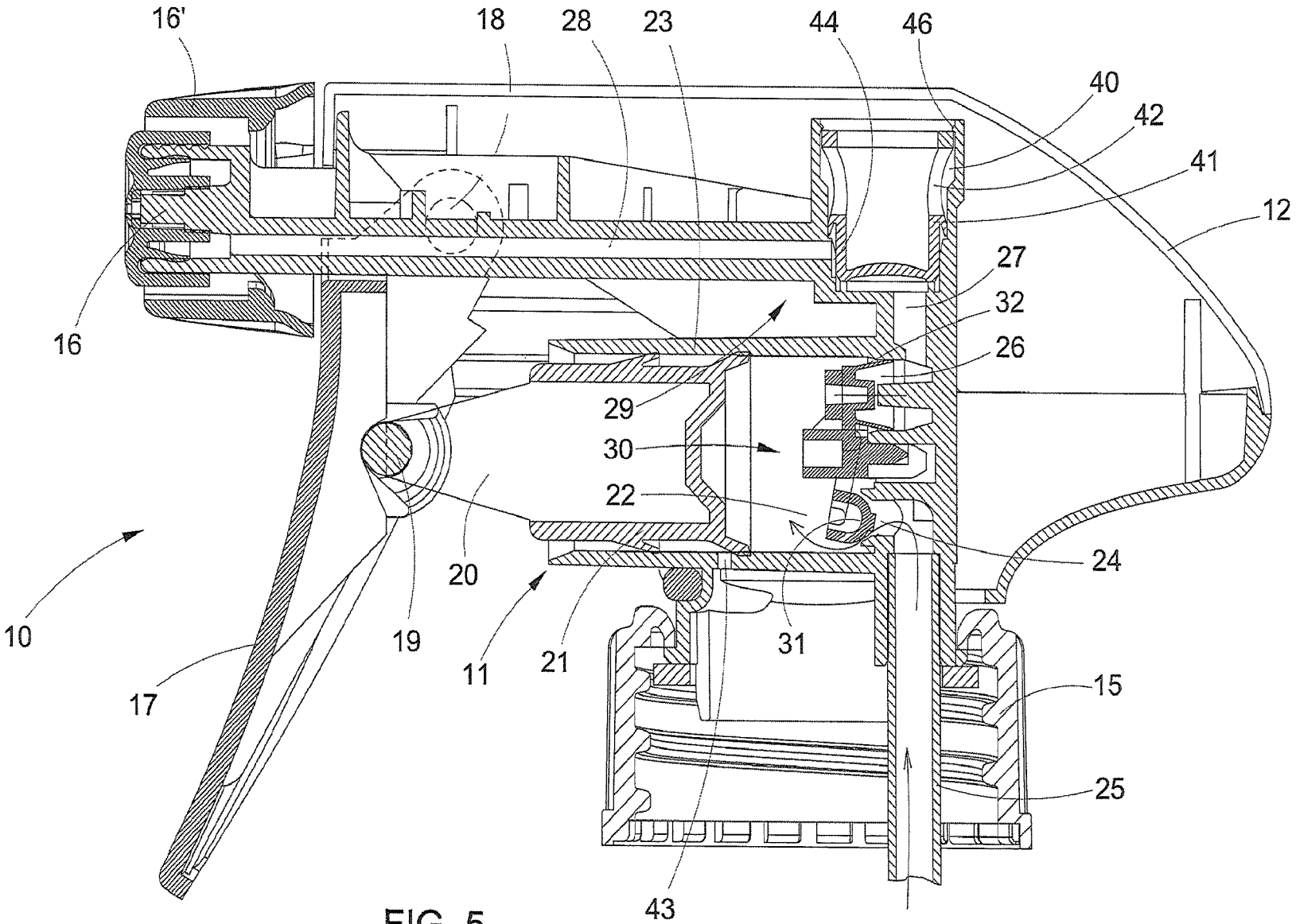

According to a further alternative embodiment, illustrated in FIG. 5 and in the detail of FIG. 6, the assembly defined by the piston or plunger 41 and by the spring 42 is stabilized in the seat 40 by means of an annular edge 46 developed along the internal circumference of the housing seat 40 and at its upper end opposite to the vertical section 27; the upper part of the spring 42, as schematized in FIGS. 5 and 6, goes to abut with the lower portion of said annular edge.

The functioning of the sprayer with precompression system will now be described, taking account of what has already been said previously about the functioning of the sprayer in itself.

On the first actuation of the trigger lever 17, with the nozzle 16 in open position, the plunger 21 pumps the air contained in the chamber 22 towards the vertical section 27 of the outlet duct 29. After some actuations the pressure in the duct 27, by acting on the base of the piston 41, causes the rising thereof in its seat 40 in contrast to the action of the precompression spring 42, thus opening the vertical passage 44 and placing in communication the duct 27 with the horizontal section 28 of the outlet duct 29 via which the air flows in order to exit from the nozzle 16. By continuing to actuate the trigger lever 17, liquid is primed from the container through the dipper tube 25 and pumped towards the outlet duct 29. The liquid which cannot be compressed will cause the raising of the piston 41, as mentioned previously, and at the same time the spring 42 will exert constantly a force in the opposite direction, creating an additional pressure on the liquid in the horizontal channel 28, which will have a greater speed or acceleration in output from the nozzle 16.

It should be noted that the constant force exerted by the precompression spring 42 on the piston 41 also allows a rapid closure of the channel 28 supplied by the piston 41 which continues to push the liquid outwards.

The practical effect obtained with the system of precompression according to the invention is that in any way the trigger lever 17 is actuated, as a hypothesis also slowly and/or partially, in any case a nebulization of the liquid is obtained at the outlet of the nozzle 16, as schematically shown in FIG. 3, thanks to the pressure exerted thereon by the precompression spring 42, which would not occur in a sprayer not provided with system of precompression.

In FIGS. 2 and 3 the arrows indicate the passage of the fluid according to the position of the trigger lever 17.

In the embodiment illustrated, the outlet channel 29 has an L configuration, with the two sections 27 and 28 orthogonal one in relation to the other and the horizontal section 28 parallel to the chamber of the pump 22.

It is however clear that the two sections 27, 28 of the outlet duct 29 can be differently angled one in relation to the other, just as the chamber of the pump 22 could be tilted with respect to said sections 27, 28.

Naturally the invention is not limited to the particular embodiment previously described and illustrated in the accompanying drawings, but instead numerous detail changes can be made thereto, within the reach of the person skilled in the art, without thereby departing from the scope of the same invention as defined in the annexed claims Embodiments of the invention relate to aerosol delivery devices and more particularly to aerosol delivery devices having improved ergonomics, spray angles, actuation systems, spray patterns, and disbursement coverage options.

What is claimed is:

1. A trigger sprayer, comprising:

a body, comprising:

a base;

a delivery nozzle;

a pumping chamber;

an inlet hole in communication with the pumping chamber;

an outlet hole in communication with the pumping chamber;

an outlet duct, comprising:

a first vertical section in communication with the outlet hole;

a second vertical section in communication with the first vertical section, wherein the first and second vertical sections are axially offset from one another; and a horizontal section in communication with the delivery nozzle;

wherein the first vertical section is disposed below the second vertical section, and the first vertical section has a smaller diameter than the diameter of the second vertical section;

a plunger positioned in the pumping chamber;

a trigger lever hinged to the body and to the plunger;

a precompression system seated in the outlet duct, the precompression system comprising:

a piston housed in the second vertical section; and a spring holding the piston in the second vertical section, wherein, a bottom most surface of the piston of the system of precompression is disposed entirely above the first vertical section such that the bottom most surface of the piston rises from a rest position, above the first vertical section, to permit fluid to pass around an exterior surface of the piston upon actuation of the trigger system.

2. The sprayer of claim 1, wherein the piston and the spring are a unitary component.

3. The sprayer of claim 1, wherein the first vertical section and horizontal section are at a right angle to each other.

4. The sprayer of claim 1, wherein the first vertical section is located behind the pumping chamber.

5. The sprayer of claim 1, wherein the horizontal section is located above the pumping chamber.

6. The sprayer of claim 1 further comprising an inlet valve cooperating with the inlet hole.

7. The sprayer of claim 6 further comprising an outlet valve cooperating with the outlet hole.

8. The sprayer of claim 1, wherein the inlet valve and outlet valve are a unitary component.

9. The sprayer of claim 1 further comprising an outlet valve cooperating with the outlet hole.

10. The sprayer of claim 1, wherein the second vertical section defines a seat, the seat comprises an opening through the body to atmosphere.

11. The sprayer of claim 10, further comprising a closure cap plugging the opening.

12. The sprayer of claim 11, wherein the spring abuts the closure cap.

13. The sprayer of claim 1, wherein the first vertical section and the second vertical section are parallel and axially offset.

14. A sprayer, comprising:

a body, comprising:

a base;

a delivery nozzle;

a pumping chamber;

an inlet hole in communication with the pumping chamber;

an outlet hole in communication with the pumping chamber;

an outlet duct, comprising:

a first vertical section in communication with the outlet hole;

a second vertical section in communication with the first vertical section, wherein the first and second vertical sections are axially offset from one another; and a horizontal section in communication with the delivery nozzle;

wherein the first vertical section is disposed below the second vertical section, and the first vertical section has a smaller diameter than the diameter of the second vertical section;

a plunger positioned in the pumping chamber;

a precompression system seated in the outlet duct, the precompression system comprising:

a piston housed in the second vertical section; and a spring holding the piston in the second vertical section, wherein, a bottom most surface of the piston of the system of precompression is disposed entirely above the first vertical section such that the bottom most surface of the piston rises from a rest position, above the first vertical section, to permit fluid to pass around an exterior surface of the piston upon actuation of the pumping chamber.

15. The sprayer of claim 14 further comprising an actuator associated with the plunger.

16. The sprayer of claim 15 wherein the actuator comprises a trigger lever hinged to the body and to the plunger.

17. The sprayer of claim 14, wherein the piston and the spring are a unitary component.

18. The sprayer of claim 14 further comprising an inlet valve cooperating with the inlet hole.

19. The sprayer of claim 18 further comprising an outlet valve cooperating with the outlet hole.

20. The sprayer of claim 19, wherein the inlet valve and outlet valve are a unitary component.

* * * * *